United States Patent [19]

Randazzo

[11] Patent Number: 4,823,697

[45] Date of Patent: Apr. 25, 1989

[54] MAGNETIC PLATE CYLINDER

[75] Inventor: Vincent Z. Randazzo, Rochester, N.H.

[73] Assignee: AM International Incorporated, Chicago, Ill.

[21] Appl. No.: 160,343

[22] Filed: Feb. 25, 1988

[51] Int. Cl.[4] ..... B41F 27/02

[52] U.S. Cl. ..... 101/375; 101/389.1; 269/8

[58] Field of Search ..... 294/65.5; 269/8; 101/375, 415.1, 378, 382 MV

[56] References Cited

U.S. PATENT DOCUMENTS

| | | | |
|---|---|---|---|
| 1,531,492 | 3/1925 | Marquardt | 269/8 |
| 1,939,681 | 12/1933 | Fleming | 101/382 MV |
| 2,243,616 | 5/1941 | Bing | 269/8 |
| 2,280,437 | 4/1942 | Levesque | 269/8 |
| 2,333,230 | 11/1943 | Beechlyn | 269/8 |
| 3,017,545 | 1/1962 | Meier | 101/382 MV |
| 3,217,645 | 11/1965 | Martt | 101/382 MV |
| 3,624,731 | 11/1971 | Lindberg | 101/382 MV |
| 3,745,626 | 7/1973 | Bray | 101/382 MV |

FOREIGN PATENT DOCUMENTS

| | | | |
|---|---|---|---|
| 186648 | 8/1956 | Austria | 101/415.1 |
| 161200 | 11/1957 | Sweden | 269/8 |

*Primary Examiner*—Clifford D. Crowder
*Attorney, Agent, or Firm*—Tarolli, Sundheim & Covell

[57] ABSTRACT

A printing plate cylinder having permanent magnets disposed therein includes an elongate member made of a highly permeable magnetic material and having a cylindrical configuration. The elongate member includes opposite axial end portions and a central portion connecting the opposite axial end portions. The elongate member is supported for rotation about its longitudinal central axis by the opposite axial end portions. The longitudinal central axis of the elongate member is parallel to and eccentric to the longitudinal central axis of the elongate member. When the elongate member is in a first position, the central portion of the elongate member is spaced away from a magnetic printing plate secured to the printing plate cylinder. In the first position of the elongate member, a magnetic field is established through the magnetic printing plate. When the elongate member is in a second position, the central portion of the elongate member is adjacent the magnetic printing plate. In the second position of the elongate member, the action of the magnetic field on the printing plate is partially terminated to provide ease of removing the magnetic printing plate from the printing plate cylinder.

7 Claims, 3 Drawing Sheets

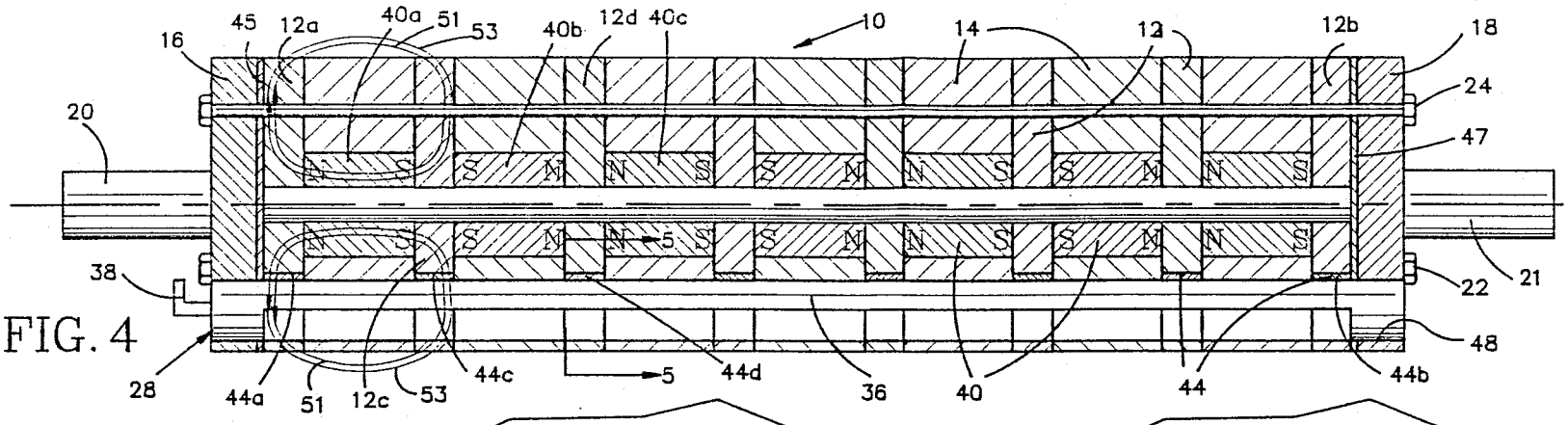
FIG. 4
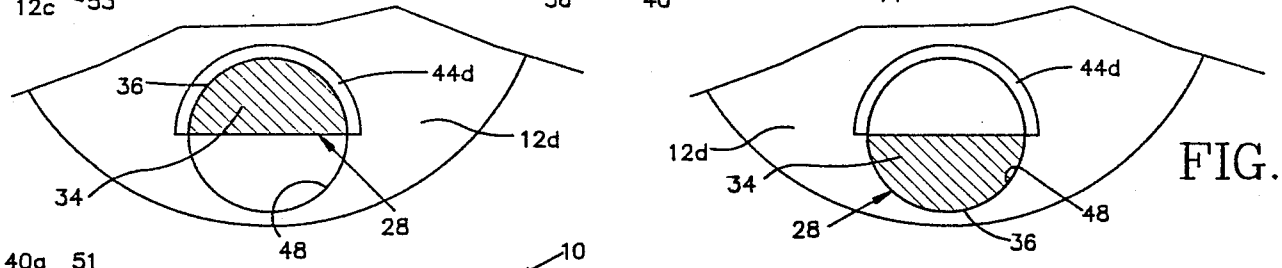
FIG. 5
FIG. 7
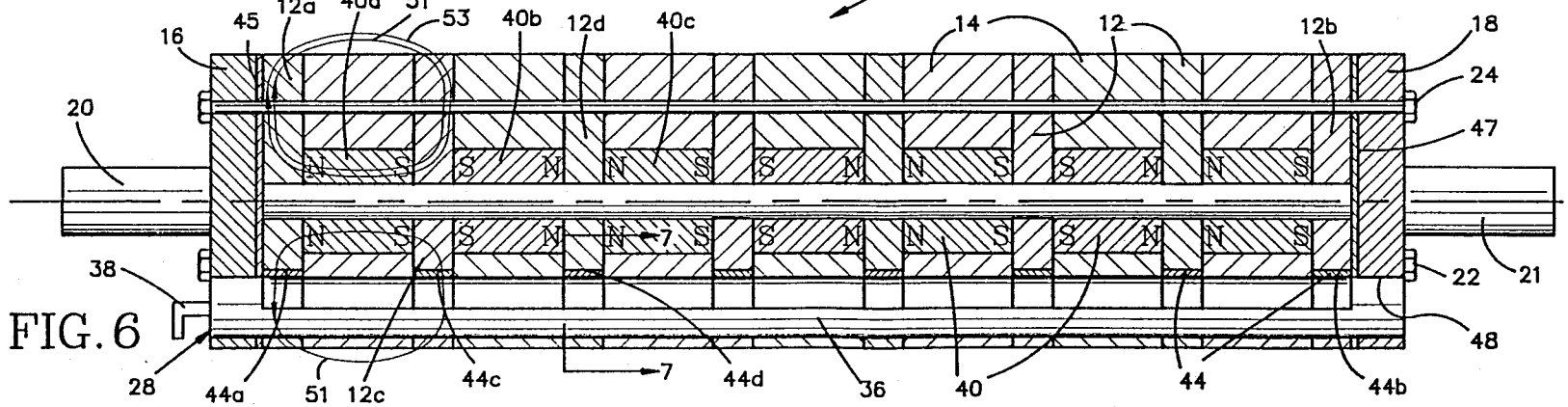
FIG. 6

MAGNETIC PLATE CYLINDER

TECHNICAL FIELD

The present invention relates to an apparatus for securing a member made of a magnetic material to a body, and particularly to a printing plate cylinder having permanent magnets for securing a metal printing plate to the printing plate cylinder.

BACKGROUND ART

A plate cylinder for use in a printing press is well known. Typically, a printing plate is secured to a plate cylinder by clamps located in an axially extending gap parallel to the longitudinal central axis of the plate cylinder. As known in the art, it is desirable to eliminate the gap. If the gap is eliminated, then the diameter of the plate cylinder can be reduced and the overall size of the printing press can thereby be reduced.

One known way of eliminating the gap is to use magnetic force to secure a magnetic (metal) printing plate to the plate cylinder. Typically, such a plate cylinder includes permanent magnets disposed within the plate cylinder. The permanent magnets provide a magnetic field with magnetic lines of flux passing through the magnetic printing plate. The magnetic force acting between the permanent magnets and the magnetic printing plate secure the magnetic printing plate to the plate cylinder.

One of the difficulties with using magnetic force to secure the magnetic printing plate to the plat cylinder is that it is difficult to remove the magnetic printing plate from the plate cylinder. This difficulty in removing the magnetic printing plate from the plate cylinder is because the magnetic force from the permanent magnets constantly act to hold the magnetic printing plate on the plate cylinder. This force must be overcome to remove the magnetic printing plate.

SUMMARY OF THE INVENTION

In accordance with the present invention, an apparatus is provided for securing a member made of a magnetic material to a body. The apparatus includes permanent magnet means on the body for providing a magnetic field in the member. The action of the magnetic field secures the member to the body. The apparatus further includes means on the body for in part terminating the action of the magnetic field in the member so that the member may be readily removed from the body.

The present invention is preferably directed to a printing plate cylinder having permanent magnets for securing a magnetic printing plate to the plate cylinder. The permanent magnets provide a magnetic field having magnetic lines of flux passing through the magnetic printing plate. The magnetic force acting between the permanent magnets and the magnetic printing plate secures the magnetic printing plate to the plate cylinder. The plate cylinder includes a member which, when moved from a first position to a second position, terminates the action of the magnetic field on a part of the magnetic printing plate. As a result, the part of the magnetic printing plate being made of resilient sheet metal material springs away from the plate cylinder. This part of the magnetic printing plate provides a lip for an operator to grasp and lift the magnetic printing plate from the plate cylinder. Ease of removal of the magnetic printing plate from the plate cylinder is thereby facilitated when the action of the magnetic field is partially terminated.

In one embodiment of the present invention, a magnetic plate cylinder includes a plurality of permanent magnets disposed within the magnetic plate cylinder for providing a magnetic field having lines of flux passing through a printing plate made of a magnetic material. The action of the magnetic force between the printing plate and the permanent magnet secures the printing plate to the magnetic plate cylinder. The magnetic plate cylinder further includes an elongate member having opposite axial end portions and a central portion connecting the axial end portions. Each axial end portion includes a cylindrical portion. The central portion has a semi-cylindrical configuration. The elongate member is supported for rotation by the cylindrical portions on each of the opposite axial ends of the member. The axis of rotation of the elongate member is parallel to and eccentric to the longitudinal central axis of the magnetic plate cylinder. The elongate member is made from a magnetic material which is highly permeable.

When the elongate member is in a first position, the semi-cylindrical, central portion of the elongate member is spaced away from the printing plate. When the elongate member is in a second position, the semi-cylindrical, central portion of the elongate member is adjacent the printing plate to partially terminate the action of the magnetic field between the printing plate and the permanent magnets within the magnetic plate cylinder. The action of the magnetic field is partially terminated because a portion of the magnetic lines of flux which originally passed through the printing plate is shorted through the elongate member. A manually operable handle is attached to one end of the elongate member for rotating the elongate member between its first and second positions.

BRIEF DESCRIPTION OF THE DRAWINGS

The foregoing and other features and advantages of the present invention will become apparent to one skilled in the art to which the present invention relates from reading the following description of the present invention in conjunction with the accompanying drawings, in which:

FIG. 4 is a sectional view of the printing plate cylinder taken approximately along line 4—4 of FIG. 2 illustrating parts in a first position;

FIG. 5 is an enlarged, sectional view of a portion of FIG. 4 taken approximately along line 5—5 of FIG. 4;

FIG. 6 is a sectional view of the printing plate cylinder similar to FIG. 4, illustrating parts in a different position;

FIG. 7 is an enlarged, sectional view similar to FIG. 5 taken approximately along line 7—7 of FIG. 6, illustrating parts in a different position;

BEST MODE OF CARRYING OUT THE INVENTION

Figures 1, 2, 3:
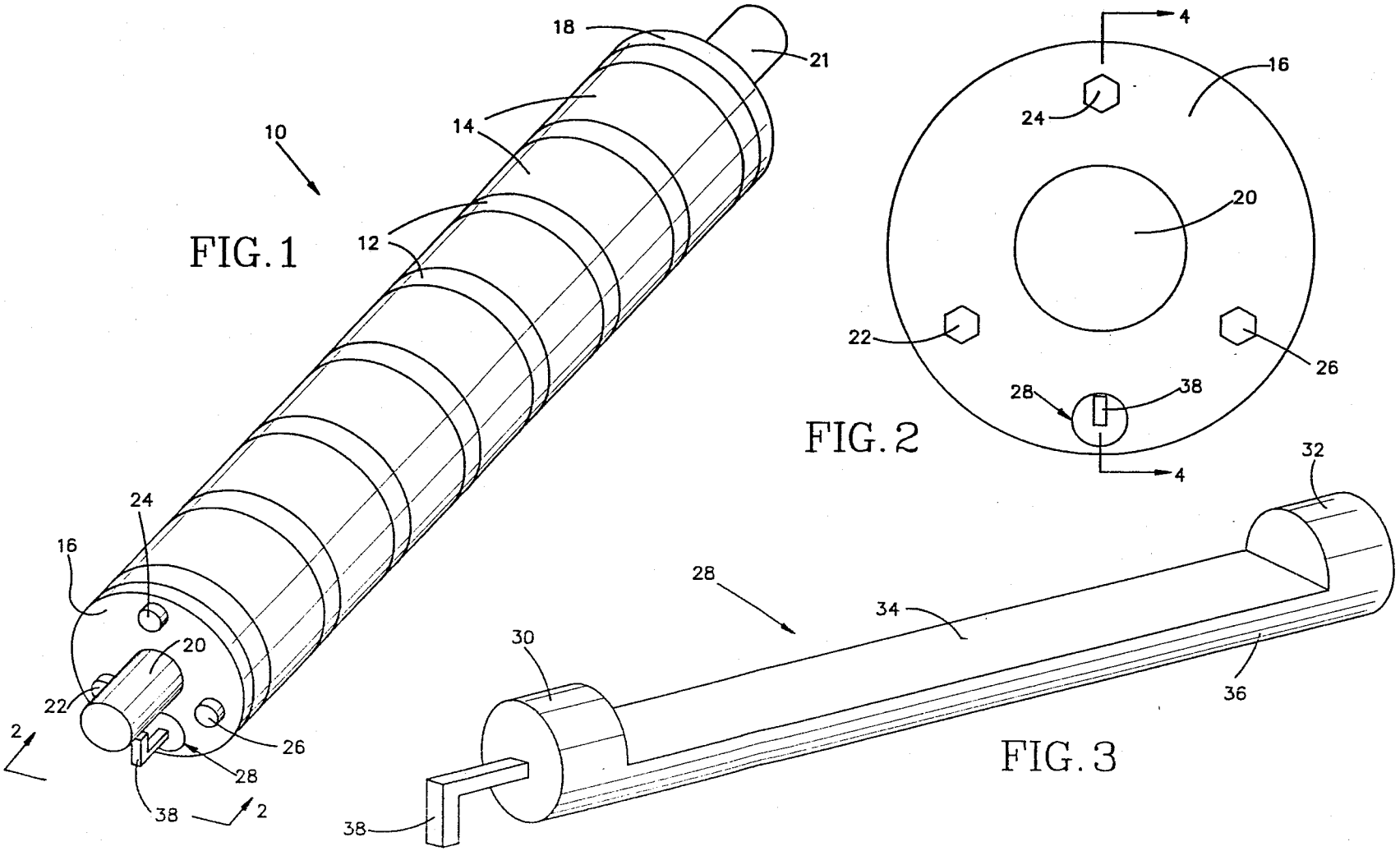
FIG. 1 is a schematic illustration of a printing plate cylinder constructed in accordance with the present invention.
FIG. 2 is an enlarged, end view taken along line 2—2 of FIG. 1.
FIG. 3 is an enlarged, perspective view illustrating a part of the printing plate cylinder of FIG. 1.

The present invention relates to an apparatus for securing a member made of a magnetic material to a body. In particular, the present invention is embodied in a magnetic plate cylinder for use in a printing press. A printing plate made of a magnetic material is secured to the magnetic plate cylinder. As representative of the present invention, a magnetic plate cylinder 10 is illustrated in FIG. 1 for supporting a printing plate (not shown in FIG. 1).

The plate cylinder 10 includes a plurality of steel discs 12 disposed along the axial extent of the cylinder 10. The steel discs 12 are equidistantly spaced apart from one another. Interposed between the steel discs 12 are a plurality of insulating discs 14 made of nonmagnetic material, such as aluminum or epoxy. The actual spacing between each steel disc is relatively small, but is exaggerated in the drawings for illustrative purposes.

Two end plates 16, 18 retain the steel discs 12 and the insulating discs 14 together. One end plate 16 of the cylinder 10 includes a stub shaft 20 projecting from the nd plate 16. Similarly, the other end plate 18 of the cylinder 10 includes a stub shaft 21 extending from the end plate 18. The stack of the steel discs 12, the insulating discs 14, and the two end plates 16, 18 are held together by securing rods 22, 24, 26 connected between the two end plates 16, 18.

The cylinder 10, shown in FIG. 4, further includes a plurality of permanent magnet, ring-shaped discs 40 disposed within the cylinder 10. The longitudinal central axis of the cylinder 10 passes through the geometric center of each permanent magnet disc. The plurality of permanent magnet discs 40 is separated by the plurality of steel discs 12 disposed along the longitudinal axis of the cylinder 10. Each permanent magnet disc has an associated insulating disc encircling and concentric with the respective permanent magnet disc. Thus, the plurality of insulating discs 14 separates the plurality of steel discs 12.

A stack is formed from the permanent magnetic discs 40, the steel discs 12, and the insulating discs 14. Except for the two steel discs **12*a*, 12*b* located at the ends of the stack, each steel disc is interposed between two permanent magnet discs. The permanent magnet discs 40 are arranged to magnetize the steel discs 12 in a manner so that each steel disc is magnetized with only one polarity. The end plate 16 is separated from its adjacent steel disc 12*a* by a suitable magnetic insulator 45. Similarly, the end plate 18 is separated from its adjacent steel disc 12*b* by a suitable magnetic insulator 47. Both magnetic insulators 45, 47 are made of a nonmagnetic material. In the arrangement illustrated, the polarity of the pole of the permanent magnet disc on one side of each steel disc is the same as the polarity of the pole of the other permanent magnet disc on the other side of the steel disc. When the permanent magnet discs 40** are arranged in this manner, every other steel disc within the stack has the same polarity, and each steel disc has a polarity opposite to all steel discs adjacent to it.

For example, a steel disc **12*c* is interposed between a permanent magnet 40*a* and a permanent magnet 40*b*. Similarly, a steel disc 12*d* is interposed between the permanent magnet 40*b* and a permanent magnet 40*c*. As illustrated in the drawing, the steel disc 12*c* is magnetized in the south direction by its two adjacent permanent magnets 40*a*, 40*b*. The steel disc 12*d* is magnetized in the north direction by its two adjacent permanent magnets 40*b*, 40*c*. Note that the steel disc 12*a* is magnetized in the north direction, and that the steel disc 12*b*** is magnetized in the south direction.

In the stacked arrangement of the steel discs 12, the insulating discs 14, and the permanent magnet discs 40, magnetic lines of flux are established through each steel disc. Except for the two steel discs **12*a*, 12*b* located at the ends of the stack, the magnetic lines of flux flowing through each steel disc is the sum of the magnetic lines of flux provided by its two adjacent permanent magnet discs. Since the two adjacent permanent magnet discs associated with each steel disc are arranged in the manner described hereinabove, the magnetic lines of flux from the two permanent magnet discs flow in the same direction through the steel disc. The result is that each steel disc is polarized in one direction. Each of the two steel discs 12*a*, 12*b* located at the ends of the stack is associated with only one adjacent permanent magnet disc. Thus, magnetic lines of flux from only the one associated adjacent permanent magnet disc flow through these two steel discs 12*a*, 12*b***.

The magnetic lines of flux through each steel disc establish a magnetic field around the outer circumferential surface of the cylinder 10. When a printing plate made of a magnetic material which is of high permeability is brought in close proximity to the outer circumferential surface of the cylinder 10, the lines of flux from the permanent magnet discs 40 pass through the printing plate. This establishes a magnetic field in the printing plate. A magnetic force acts between the printing plate and the permanent magnet discs 40. The printing plate is thereby secured to the outer circumferential surface of the cylinder 10.

The cylinder 10 further includes an elongate member 28 having a cylindrical configuration for terminating the action of the magnetic field in the printing plate. The elongate member 28 extends from end plate 16 to the other end plate 18 through a cylindrical bore 48. The longitudinal central axis of the cylindrical bore 48 and elongate member 28 is parallel to the longitudinal central axis of the cylinder 10. The elongate member 28 is made of a magnetic material which is highly permeable.

The elongate member 28, shown in FIG. 3, includes opposite axial end portions 30, 32. The elongate member 28 further includes a central portion 34 connecting the opposite axial end portions 30, 32. The central portion 34 has a semi-cylindrical configuration with a semi-circular outer surface 36. Each of the axial end portions 30, 32 has a cylindrical configuration. The diameter of the end portion 30 is the same as the diameter of the end portion 32. The radius of the semi-cylindrical central portion 34 is the same as the radius of the two end portions 30, 32. The outer surface 36 of the central portion 34 is continuous with the outer cylindrical surfaces of the end portions 30, 32. The elongate member 28 further includes a handle 38 connected to the end portion 30 along the longitudinal central axis of the elongate member 28. The handle 38 may be manually engaged to rotate the elongate member 28 between a first position and a second position.

Referring to FIG. 4, the first position of the elongate member 28 relative to the cylinder 10 is shown. The elongate member 28 is disposed within the cylindrical bore 48. The two end portions 30, 32 are supported for rotation by the end plates 16, 18 for rotation about the longitudinal central axis of the bore 48.

A plurality of suitable magnetic insulators 44 are disposed throughout the interior surface of the bore 48. More specifically, half of the interior, arcuate surface associated with the bore 48 through each steel disc is magnetically insulated by an associated magnetic insulator from the outer surface 36 of the central portion 34 of the elongate member 28. The other half of the interior, arcuate surface is not magnetically insulated from the outer surface 36 of the central portion 34 of the elongate member 28. When the elongate member 28 is in the first position of FIG. 4, the outer surface 36 is in contact with only the magnetically insulated half of the surface associated with the bore 48 through each steel disc. Thus, the lines of flux from each permanent magnet disc flow through only the two steel discs adjacent to the permanent magnet. No lines of flux flow through the elongate member 28.

Referring to FIG. 5, the first position of the elongate member 28 will be better understood. One half of the interior, arcuate surface of the bore 48 through the steel disc **12*d* is magnetically insulated from the elongate member 28 with a magnetic insulator 44*d*. The insulated half of the surface is that half of the interior, arcuate surface which is geometrically nearest the longitudinal central axis of the cylinder 10. The other half of the interior, arcuate surface is not magnetically insulated. When the elongate member 28 is in the position shown in FIG. 5, the outer surface 36 of the central portion 34 of the elongate member 28 abuts only the magnetically insulated portion of the interior, arcuate surface. The outer surface 36 is not in contact with any portion of the steel disc 12*d*. Each of the other steel discs is magnetically insulated from the elongate member 28** in the same manner.

When the elongate member 28 is in the first position as shown in FIG. 4, the magnetic lines of flux between the steel disc **12*a* and the adjacent steel disc 12*c* are of equal density around the outer circumference of the cylinder 10. This equal density is designated by flux lines 51 and 53. The lines 51 and 53 sweep around about the longitudinal central axis of the cylinder 10. Although only the flow of the magnetic lines of flux is described with respect to the permanent magnet disc 40*a* between the steel discs 12*a*, 12*c*, the flow of the lines of flux associated with each of the other permanent magnet discs is the same. When the magnetic printing plate (not shown in FIG. 4) is brought in close proximity to the cylinder 10, a magnetic force acts between the magnetic printing plate and the permanent magnet discs 40 to secure the magnetic printing plate to the cylinder 10**.

Figure 8:
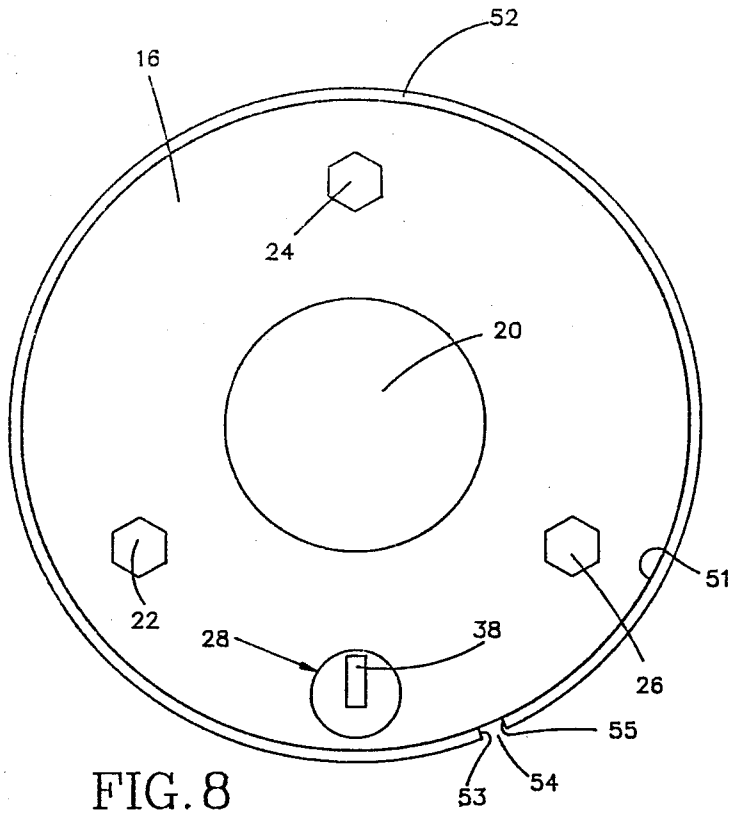
FIG. 8 illustrates the view of FIG. 2 with a magnetic printing plate secured to the magnetic plate cylinder.

Referring to FIG. 8, the cylinder 10 of FIG. 2 is illustrated with a magnetic printing plate 52 secured thereto. The elongate member 28 is in the first position. Since the elongate member 28 is in the first position, the density of the magnetic lines of around the outer circumference of the cylinder 10 is the same. Thus, the magnetic field intensity in the printing plate 52 at any point on a given circumference around the cylinder 10 is the same as the magnetic field intensity at any other point on the given circumference. The magnetic force acting between the printing plate 52 and the permanent magnet discs 40 is sufficient to completely secure one major side surface 51 of the printing plate 52 to the outer circumferential surface of the cylinder 10. A gap 54 is established between two end edges 53, 55 of the printing plate 52. The size of the printing plate 52 is selected so that the gap 54 is extremely small in size along the axial extent of the cylinder 10. The enlarged size of the gap 54 in the drawings is exaggerated for illustrative purposes.

The second position of the elongate member 28 relative to the cylinder 10 is shown in FIG. 6. Movement of the elongate member 28 from the first position to the second position is accomplished by moving the handle 38 through an angular displacement of 180°. When the elongate member 28 is moved from the first position to the second position, the central portion 34 of the elongate member 28 within the bore 48 is rotated 180°. As shown in FIG. 7, after the central portion 34 of the elongate member 28 is rotated 180°within the bore 48 from the first position (FIG. 5) to the second position (FIG. 7), the outer surface 36 of the central portion 34 abuts the noninsulated half of the bore 48 through the steel disc **12*d***.

When the elongate member 28 is in the second position as shown in FIG. 6, the magnetic lines of flux from the permanent magnet disc **40*a* between the steel disc 12*a* and the steel disc 12*c* are not of equal density around the outer circumference of the cylinder 10. The density of the magnetic lines of flux around the circumference of the cylinder 10 is of equal density except near the area of the bore 48 where the central portion 34 of the elongate member 28 makes contact with the steel disc 12*a* and the steel disc 12*c*. Although only the flux density distribution associated with the permanent magnet disc 40*a*** is described, the flux density distribution associated with the other permanent magnet discs is the same.

In the area of the bore 48, the density of the magnetic lines of flux through the steel disc **12*a* and the steel disc 12*c* is substantially less. As depicted in FIG. 6, this smaller flux density is designated by only the presence of flux line 51 near the area of the bore 48. The reason for this is because the central portion 34 of the elongate member 28 provides a parallel reluctance path for the magnetic lines of flux. Since the elongate member 28 is made of a magnetic material which is highly permeable, the magnetic lines of flux are shorted through the central portion 34 of the elongate member 28. The result is that the magnetic field intensity in this area, and thus the magnetic force acting between the magnetic printing plate and the permanent magnet discs 40 in this area is substantially weaker and for practical purposes is terminated. Thus, when the elongate member 28 is in the second position, the magnetic printing plate is not as tightly secured to the cylinder 10** near the area of the bore.

Figure 9:
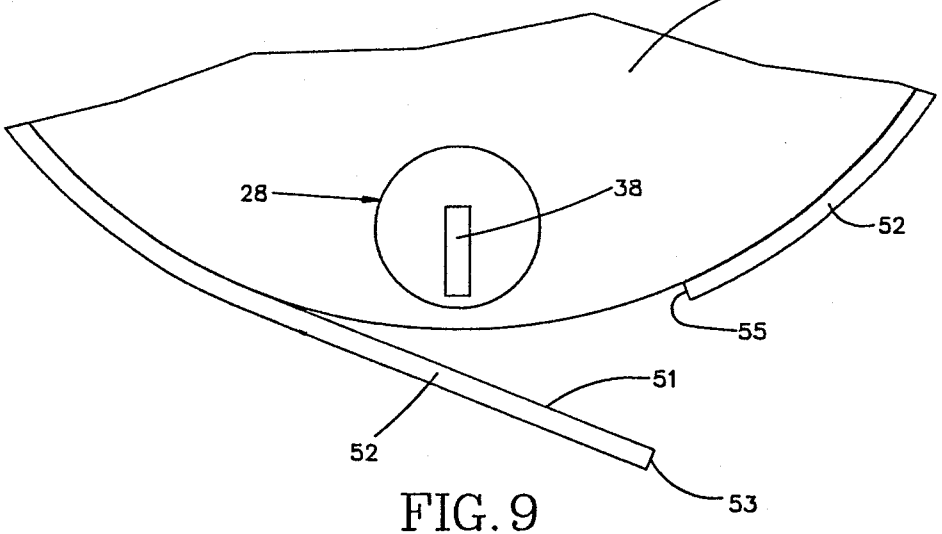
FIG. 9 is an enlarged view of a portion of FIG. 8, illustrating a position of the magnetic printing plate relative to the magnetic plate cylinder in the process of being removed from the plate cylinder.

Referring to FIG. 9, the details of the printing plate 52 relative to the cylinder 10 when the elongate member is in the second oosition are shown. When the elongate member 28 is in the second position, the density of the magnetic lines of flux passing through the printing plate 52 near the bore 48 is relatively less. The magnetic field intensity of a point in the printing plate 52 near the bore 48 is substantially weaker than the magnetic field intensity of a point in the printing plate 52 located away from the bore 48. Thus, the magnetic force acting between the printing plate 52 and the permanent magnet discs 40 near the bore 48 is substantially weaker.

The weaker magnetic force results in the edge 53 of the magnetic printing plate 52 springing away from the outer circumferential surface of the cylinder 10. This occurs because of the resilient characteristics of the printing plate 52. When this occurs, the printing plate 52 is easily removable from the cylinder 10 because the edge 53 provides a lip for an operator to grasp and lift the printing plate 52 from the outer circumferential surface of the cylinder.

If the edge 53 of the printing plate 52 is not sprung away from the cylinder 10, then removal of the printing plate 52 would be difficult. The use of the elongate member 28 provides the capability for springing the edge 53 of the printing plate 52 away from the cylinder 10 when it is so desired. Removal of the printing plate 52 from the cylinder 10 is thereby facilitated.

The invention has been described above with reference to a preferred embodiment. Modifications and alternations may become apparent to one skilled in the art upon reading and understanding the specification. It is intended to include all such modifications and alterations within the scope of the appended claims.

Having described a preferred embodiment of the invention, I claim:

1. An apparatus comprising:

a printing plate cylinder;

a magnetic printing plate to be secured to said printing plate cylinder;

permanent magnet means disposed within the printing plate cylinder for providing a magnetic field in the magnetic printing plate, the action of the magnetic field between the magnetic printing plate and said permanent magnet means securing the magnetic printing plate to the printing plate cylinder; and shorting means disposed on the printing plate cylinder and movalbe relative thereto for terminating action of the magnetic field between the magnetic printing plate and said permanent magnet means, said shorting means being made from highly permeable magnetic material and including an elongate member having opposite axial end portions and a central portion connecting said axial end portions, said elongated member being supported by said opposite axial end portions on the printing plate cylinder for rotation about an axis parallel to and spaced from the longitudinal central axis of the printing plate cylinder;

said elongate member haaving a first position in which said central portion of said elongate member is isolated from said permanent magnet means and magnetic lines of flux of the magnetic field pass through a first reluctance path in the magnetic printing plate and a second position in which said central portion of said elongate member engages said permanent magnet means and the magnetic lines of flux of the magnetic field pass through a second reluctance path in said central portion extending parallel to said first reluctance path in the magnetic printing plate whereby the magnetic field in the magnetic printing plate is shorted and the magnetic printing plate can be removed from the printing plate cylinder.

2. The apparatus of claim 1 wherein the printing plate cylinder comprises a plurality of steel disc equidistantly spaced apart from one another and a plurality of insulating disc for separating said steel discs, said permanent magnet means including a plurality of cylindrical magnetic discs disposed along the axial extent of the printing plate cylinder, the longitudinal central axis of the printing plate cylinder passing through the geometric center of said cylindrical magnetic discs, each of said cylindrical magnetic discs being encircled by a respective insulating disc and each of said cylindrical magnetic discs having opposite end surfaces abutting respective end surfaces of respective steel discs.

3. The apparatus of claim 2 wherein said axial end portions have a circular cross-section and said central portion has a semi-circular cross-section having the same radius as said axial end portions, and the printing plate cylinder comprises a longitudinal bore for receiving said elongate member.

4. The apparatus of claim 3 further comprising a plurality of insulating rings for insulating said central portion of said elongate member from said steel discs in the first position of said elongate member.

5. The apparatus of claim 1 further comprising lever means connected to one of said axial end portions for rotating said elongate member about said axis between said first and second positions.

6. An apparatus for securing a magnetic printing plate, which is made of a resilient material and extends around a printing plate cylinder, to the printing plate cylinder, the printing plate cylinder having in the area of attachment of an edge portion of the magnetic printing plate a longitudinal bore having an axis spaced from and extending parallel to the central longitudinal axis of the printing plate cylinder, said apparatus comprising:

permanent magnet means disposed within the printing plate cylinder for providing a magnetic field in the magnetic printing plate throughout the extent of the magnetic printing plate, the action of the magnetic field between the magnetic printing plate and said permanent magnet means securing the magnetic printing plate to the printing plate cylinder; and shorting means disposed on the printing plate cylinder and movable relative thereto for terminating action of the magnetic field between the edge portion of the magnetic printing plate and said permanent magnet means, said shorting means being made from highly permeable magnetic material and including an elongate member having opposite axial end portions and a central portion connecting said axial end portions, said elongate member being received in the longitudinal bore in the printing plate cylinder;

said elongate member having a first position in which said central portion of said elongate member is spaced away from the edge portion of the magnetic printing plate so that magnetic lines of flux of the magnetic field pass through a first reluctance path in the edge portion of the magnetic printing plate, and a second position in which said central portion of said elongate member is adjacent to the magnetic printing plate so that the magnetic lines of flux of the magnetic field pass through a second reluctance path in said central portion and extending substantially parallel to said first reluctance path in the edge portion of the magnetic printing plate whereby the magnetic field in the edge portion of the magnetic printing plate is shorted and the edge portion of the magnetic printing plate springs away from the printing plate cylinder to form a lip to be grasped for removing the magnetic printing plate from the printing plate cylinder.

7. The apparatus of claim 6 wherein the printing plate cylinder comprises a plurality of steel discs equidistantly spaced apart from one another and a plurality of insulating disc for separating said steel discs, said permanent magnet means includes a plurality of cylindrical magnetic discs disposed along the axial extend of the printing plate cylinder, the longitudinal central axis of the printing plate cylinder passing through the geometric center of said cylindrical magnetic discs, each of said cylindrical magnetic discs being encircled by a respective insulating disc and each of said cylindrical magnetic discs having opposite end surfaces abutting respective end surfaces of respective steel discs, said axial end portions having a circular cross-section and said central portion having a semi-circular cross-section having the same radius as said axial end portions, and said apparatus further comprises a plurality of insulating rings for insulating said central portion of said elongate member from said steel discs in the first position of said elongate member.

* * * * *